US006098558A

United States Patent [19]

Baird

[11] Patent Number: 6,098,558

[45] **Date of Patent: *Aug. 8, 2000**

[54] ELONGATE ARTICLE HOLDING SYSTEM AND METHOD FOR MAKING SAME

[76] Inventor: Daniel W. Baird, 5835 Sullivantown Rd., Walkertown, N.C. 27051

[ * ] Notice: This patent is subject to a terminal disclaimer.

[21] Appl. No.: 09/109,593

[22] Filed: Jul. 2, 1998

Related U.S. Application Data

[63] Continuation-in-part of application No. 08/779,404, Jan. 7, 1997, Pat. No. 5,842,584.

[60] Provisional application No. 60/010,519, Jan. 24, 1996, and provisional application No. 60/029,808, Oct. 25, 1996.

[51] Int. Cl.[7] ..... D05B 11/00

[52] U.S. Cl. ..... 112/475.08; 112/413; 211/69; 211/70.6; 224/223

[58] Field of Search ..... 112/470.31, 104, 112/152, 406, 413, 475.01, 475.08, 475.14, 410, 417; 2/311, 312, 330, 94, 161.4; 211/70.6, 69, 69.1; 207/227, 901.4; 206/372, 379

[56] References Cited

U.S. PATENT DOCUMENTS

| | | | |
|---|---|---|---|
| 1,073,479 | 9/1913 | Dunbar et al. | 2/94 |
| 3,277,855 | 10/1966 | Roing | 112/413 |
| 4,268,917 | 5/1981 | Massey | 2/94 X |
| 4,508,221 | 4/1985 | Olson | 206/379 |
| 4,797,040 | 1/1989 | Hibbard | 408/241 |
| 4,988,338 | 1/1991 | Taylor, et al. . | |
| 5,056,661 | 10/1991 | Balzano | 206/372 |
| 5,127,565 | 7/1992 | Grant | 2/94 X |
| 5,199,621 | 4/1993 | McLennan . | |
| 5,365,609 | 11/1994 | Herzog | 2/161.4 |
| 5,591,122 | 1/1997 | Yewer, Jr. | 2/312 X |
| 5,600,854 | 2/1997 | Henrekin . | |
| 5,664,673 | 9/1997 | Perry . | |
| 5,842,584 | 12/1998 | Baird | 211/69.1 |

*Primary Examiner*—Ismael Izaguirre
*Attorney, Agent, or Firm*—Kilpatrick Stockton LLP; Charles W. Calkins; James J. Bindseil

[57] ABSTRACT

A holding system and method that comprises a self-closing sleeve for holding an elongate article. The sleeve is formed between the spaced, lateral attachment of a retaining strip and base strip. Additionally, the sleeve uniquely provides an open-biased end that allows for the trouble-free insertion of an elongate article into the sleeve. The retaining strip has a relaxed length and a stretched length. One longitudinal edge of the retaining strip is maintained at a stretched length by an impeding member, while the opposing edge freely contracts to the relaxed length. As such, the lateral attachment of two portions of the retaining strip that are substantially parallel when in a relaxed length provide the open-biased end. Similarly, the spacing of the lateral attachments facilitates the self-closing feature of the sleeve by maintaining tension in the sleeve that allows the sleeve to securely and reliably hold an elongated article. Additionally, the holding system may comprise a rigid base, that may be flexed, affixed to the base strip. Further, an intermediate strip may be provided between the retaining strip and the base strip. Preferably, the intermediate strip and the base strip are complementary hook-and-loop plies that further aid in holding the elongate article. Finally, the invention also includes a method for making the holding system.

46 Claims, 8 Drawing Sheets

ELONGATE ARTICLE HOLDING SYSTEM AND METHOD FOR MAKING SAME

CROSS-REFERENCE TO RELATED APPLICATIONS

This is a continuation-in-part of U.S. application Ser. No. 08/779,404, filed Jan. 7, 1997, now U.S. Pat. No. 5,892,584, which claims the benefit of U.S. Provisional Application No. 60/010,519, filed Jan. 24, 1996, and U.S. Provisional Application No. 60/029,808, filed Oct. 25, 1996.

FIELD OF THE INVENTION

The present invention relates to devices for holding elongate articles, and more particularly, to an elastic strip system for holding elongate articles.

BACKGROUND

It has been suggested that the secure storage of elongate articles has been a problem for many years, leading to much expenditure of inventive effort. For example, there may be problems in storing accessories for power tools such as electric drills, saws, and drivers. These accessories include drill bits, cutting bits, driver bits and chuck keys. Often, these accessories are relatively small and thus easy to misplace. These small elongate accessories are critical to the performance of the power tool, however, so they must be stored securely while still allowing ready access.

Users of power tools often store these accessories in the original packaging of the power tool or the accessory. This approach is less than desirable when the package is missing, destroyed, or otherwise rendered inoperative. Worse yet, some users simply throw these accessories into a large toolbox, where they can be lost or damaged.

Numerous other applications exist where the secure and reliable storage of elongate articles is desired. Examples include storing pens, pencils, rulers, scissors, screw drivers, wrenches, combs, keys, screws, toothbrushes, air pressure gauges, shaving devices, razors, paint brushes, thermometers, medical instruments, nail clippers, computer accessories and bobby pins in applications ranging from desk top to work shop to automobile to kitchen to bathroom to business to medical to sporting to construction. This list is not comprehensive, but merely touches on the potential elongate articles and the potential applications where secure and reliable storage of elongate articles is desired.

The art has addressed these shortcomings in the storage of elongate accessories by providing several devices. Although these devices are improvements, they frequently rely upon elastic members to retain the elongated articles. These elastic members, however, suffer from several shortcomings. For example, some prior art may use loops or tubes of elastic material to retain an article. Typically, the loops or tubes of elastic have a consistent diameter that requires the article being held to be larger in diameter than the loop or tube. As such, it is often difficult to insert the article into the loop or tube because it must be forced through the smaller diameter loop or tube. Working an article of a larger diameter into the opening of a smaller diameter loop or tube can therefore be a frustrating, complicated and time-consuming process. Further, articles that may be easily inserted into the loop or tube cannot be securely and reliably held because the diameter of the article is smaller than the diameter of the loop or tube. Elongate articles of smaller diameter than the loop or tube may be held in a horizontal position, but not be securely held at angles or in the vertical position without the assistance of other devices, like stops. Thus, prior art devices typically rely on the elongate article having a larger diameter than the opening of the loop or tube in order to securely and reliably hold the article.

SUMMARY OF THE INVENTION

The present invention discloses a number of embodiments of an elongate article holding system and a method of making the system. The holding system comprises a first substantially non-elastic strip and a second substantially elastic strip. The second strip has a first edge of a stretched length and a second edge of a relaxed length. The first and second strips are spacedly attached together. The system of the present invention advantageously provides a self-closing sleeve formed between the spaced attachment of the first strip and the second strip that allows for improved security and reliability in holding elongate articles.

Additionally, the sleeve uniquely comprises an open-biased end that beneficially aids in inserting elongate articles into the sleeve. The open-biased end preferably corresponds to the first edge of the second strip when the longitudinal edges of the second strip are substantially straight. When the system is configured such that the longitudinal edges of the second strip are substantially curved, however, the open-biased end may correspond to the second edge of the second strip.

The system preferably provides the first strip with a width wider than a width of the second strip. The wider first strip enhances the ability to insert an elongate article into the sleeve. Further, an impeding member may be affixed to the first edge of the second strip to achieve the stretched length. The impeding member preferably comprises a sewn stitch, but other methods may be utilized. Also preferably, the first strip comprises a hook ply.

The system may additionally comprise other elements, such as a rigid base, a hanger device and a closure device. The rigid base may be attached to the first strip to provide a firm backing to the system. The hanger device may be movably attached to at least one of the first strip or the second strip, and it may comprise a ring for hanging the system on a nail or hook, for example. Similarly the closure device may be movably attached to at least one of the first strip or the second strip, and may be utilized when the system is configured as a belt to be attached and removably fastened to an object.

In another embodiment, a holder for elongate articles, comprises a first substantially non-elastic strip, a second substantially non-elastic strip adjacent to the first strip, and a third substantially elastic strip, having a first edge of a stretched length and a second edge of a relaxed length, spacedly attached to the first strip and the second strip. Similar to above, this embodiment also features a self-closing sleeve formed between the spaced attachment of the first strip, the second strip and the third strip.

Additionally, the sleeve uniquely comprises an open-biased end that beneficially aids in inserting elongate articles into the sleeve. The open-biased end preferably corresponds to the first edge of the third strip when the longitudinal edges of the third strip are substantially straight. When the system is configured such that the longitudinal edges of the third strip are substantially curved, however, the open-biased end may correspond to the second edge of the third strip.

The system preferably provides the first strip with a width wider than a width of the second strip and a width of the third strip. The wider first strip enhances the ability to insert an elongate article into the sleeve. Further, an impeding member may be affixed to the first edge of the third strip to achieve the stretched length. The impeding member preferably comprises a sewn stitch, but other methods may be utilized. Also preferably, the first strip comprises a hook-and-loop ply and the second strip comprises a complementary hook-and-loop ply, although matching hook-and-loop plies may be utilized.

This embodiment may additionally comprise other elements, such as a rigid base, a hanger device and a closure device. The rigid base may be attached to the first strip to provide a firm backing to the system. The hanger device may be movably attached to any and/or all of the first strip, the second strip and the third strip, and it may comprise a ring for hanging the system on a nail or hook, for example. Similarly the closure device may be movably attached to at least one of the first strip, second strip or third strip, and may be utilized when the system is configured as a belt to be attached and removably fastened to an object.

In yet another embodiment, a holder for elongate articles, comprises a first hook and-loop ply, a substantially elastic strip having a first edge of a stretched length and a second edge of a relaxed length, and a second hook-and-loop ply, complementary to the first hook-and-loop ply. The second hook-and-loop ply is located between the first hook-and-loop ply and the elastic strip, wherein the first ply, the elastic strip and the second ply are spacedly attached. This embodiment may additionally comprise a rigid base attached to the first hook-and-loop ply.

Further, the present invention discloses a method of making a holder for elongate articles, comprising the steps of providing a substantially elastic strip, expanding the elastic strip in the longitudinal direction to a stretched length, constraining one longitudinal edge of the elastic strip from releasing to a relaxed length, and spacedly affixing the elastic strip to a substantially non-elastic strip. Additionally, the method may comprise affixing a rigid base to the non-elastic strip. The non-elastic strip is preferably a first hook-and-loop ply. Still further, the method may comprise additionally providing a second hook-and-loop ply, complementary to the first hook-and-loop ply, and spacedly affixing the second hook-and-loop ply between the elastic strip and the first hook-and-loop ply.

DETAILED DESCRIPTION OF THE INVENTION

Figure 1:
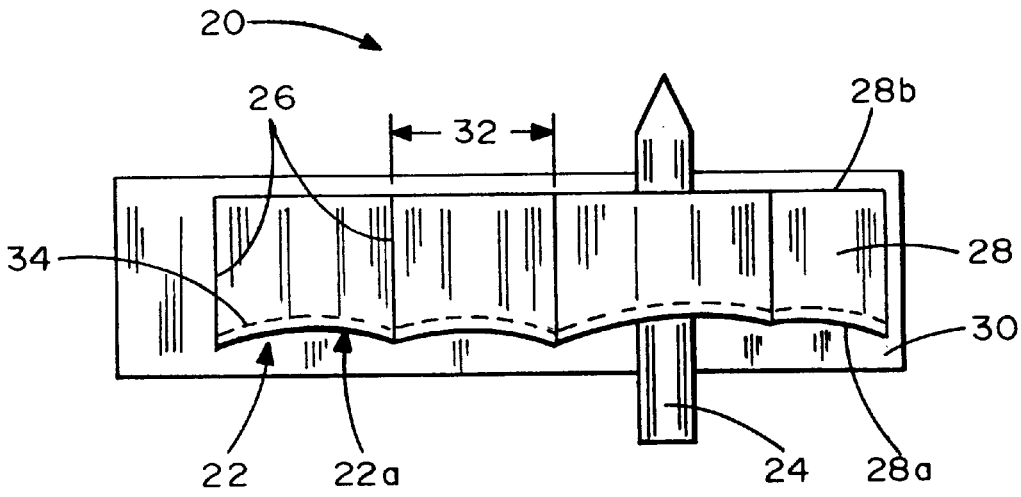
FIG. 1 is a top plan view of one embodiment of a holding strip system of the present invention.
Figure 2:
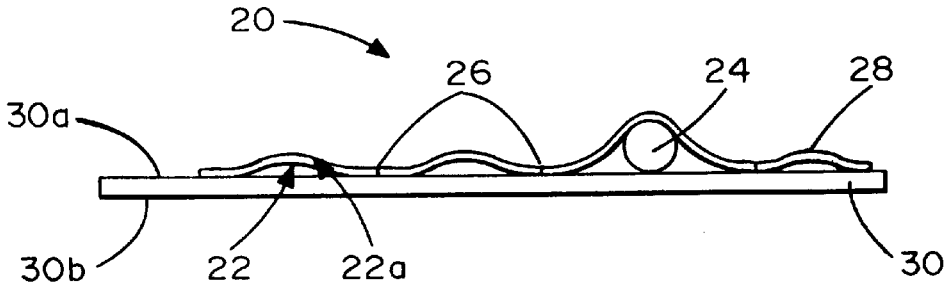
FIG. 2 is a side view of FIG. 1.

According to the present invention, referring to FIGS. 1 and 2, an elongate article holding strip system 20 comprises an advantageous self-closing sleeve 22 for holding an elongate article 24. Sleeve 22 achieves the self-closing feature by maintaining a substantially closed position until the insertion of article 24. Upon insertion of article 24, sleeve 22 is formed to accommodate article 24 while applying pressure to hold the article. Additionally, sleeve 22 uniquely provides a open-biased end 22*a* that allows for the trouble-free insertion of elongate article 24 into the sleeve.

Sleeve 22 is formed between the spaced, lateral attachment 26 of retaining strip 28 to base strip 30. Sleeve 22 may securely and reliably hold any sized article 24 by varying the width 32 of the spaced, lateral attachment of retaining strip 28 and base strip 30 that forms the sleeve. System 20 may comprise a single sleeve 22, or a plurality of sleeves of similar or varying widths 32.

The features of open-biased end 22*a* and self-closing sleeve 22 are provided by the unique construction of retaining strip 28. Retaining strip 28 comprises a resilient, stretchable material, as discussed in more detail below, having a relaxed length and a stretched length. Retaining strip 28 beneficially provides a front edge 28*a* maintained at a stretched length by an impeding member 34, while a back edge 28*b* freely contracts to the relaxed length. Impeding member 34 prohibits front edge 28*a* from fully contracting to the relaxed length. As such, lateral attachment 26 of two portions of retaining strip 28 that are substantially parallel when in a relaxed length provide open-biased end 22*a* corresponding to front edge 28*a*. Similarly, self-closing sleeve 22 maintains a closed position by locating lateral attachments 26 that dictate width 32 of the sleeve at a distance not substantially less than the distance between the attachments at a relaxed length of retaining strip 28. The spacing of lateral attachments 26 thereby facilitates the self-closing feature of sleeve 22 by maintaining tension in the sleeve that allows the sleeve to securely and reliably hold elongated article 24.

Retaining strip 28 is a durable, extendible material that may be stretched by the application of force, but that substantially returns to a relaxed length upon release of the force. Retaining strip 28 is durable and tough enough to withstand the repetitious insertion of elongate article 24, that often may have sharp points or edges, while still maintaining its resiliency. Suitable materials for retaining strip 28 comprise elastics, rubber, nylon, plastic and other artificial fibers, and the like.

As stated above, impeding member 34 prohibits front edge 28*a* from fully contracting to the relaxed length. Impeding member 34 is preferably a longitudinal stitch sewn adjacent front edge 28*a* while retaining strip 28 is at a stretched length. Impeding member 34 may comprise other embodiments that provide front edge 28*a* with flexibility yet prohibit contraction, such as hardening a flexible glue, molding a flexible material, and possibly even melting the material of retaining strip 28 along edge 28*a*.

Base strip 30 is preferably a flexible, yet substantially non-elastic material. Non-flexible materials, however, may be utilized as long as lateral attachment 26 with retaining strip 28 can be maintained in a highly repetitive environment of inserting and removing elongate article 24. Suitable materials for base strip 30 comprise hook-and-loop material, leather, rubber, nylon, plastic, vinyl and other rugged components. Base strip 30 has a top surface 30*a* in contact with retaining strip 28 and a bottom surface 30*b* that may be affixed to other surfaces.

In one preferred embodiment, top surface 30*a* comprises hook material that advantageously grasps retaining strip 28 comprising a loose-weaved elastic material. The interaction of the hook material of base strip 30 with the loose-weaved elastic material of retaining strip 28 advantageously provides increased surface area contact with an inserted elongate article 24 which beneficially increases the security and reliability of holding strip 20.

Lateral attachment 26 affixes retaining strip 28 to base strip 30 to form sleeve 22. Lateral attachment 26 preferably comprises a lateral stitch sewn through both strips 28, 30 from front edge 28*a* to back edge 28*b*. Lateral attachment 26 may also comprise gluing, sonic welding, stapling, tacking, clamping and other similar methods of attaching retaining strip 28 to base strip 30 that substantially maintain width 32 of sleeve 22.

Other embodiments of the present invention will now be described. In the description and figures pertaining to these embodiments, elements of the system that have already been described above have the same reference numeral.

Figure 3:
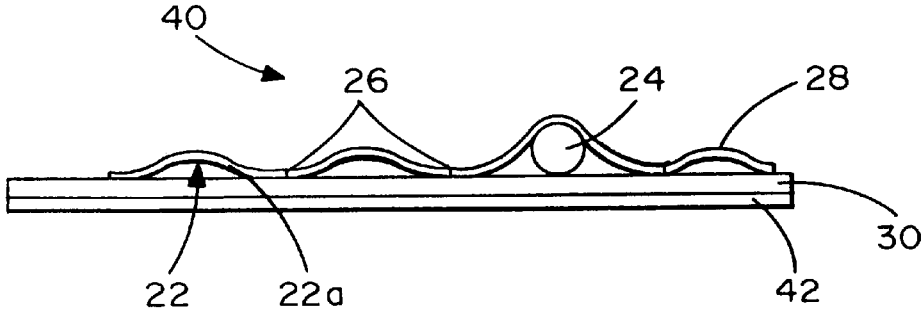
FIG. 3 is a side view, similar to that of FIG. 2, of another embodiment of the present invention.

In an alternate embodiment, referring to FIG. 3, a holding strip system 40 is similar to system 20 (FIGS. 1 and 2) but additionally comprises a rigid base plate 42 affixed to base strip 30. Base plate 42 advantageously keeps base strip 30 flat, which urges elongated article 24 to stretch retaining strip 28, thereby increasing the hold of sleeve 22 on the article. Similar to lateral attachment 26, base plate 42 may be affixed to base strip 30 by sewing, gluing, sonic welding, stapling, tacking, clamping and other similar methods of maintaining the base strip flat against the base plate.

Figure 4:
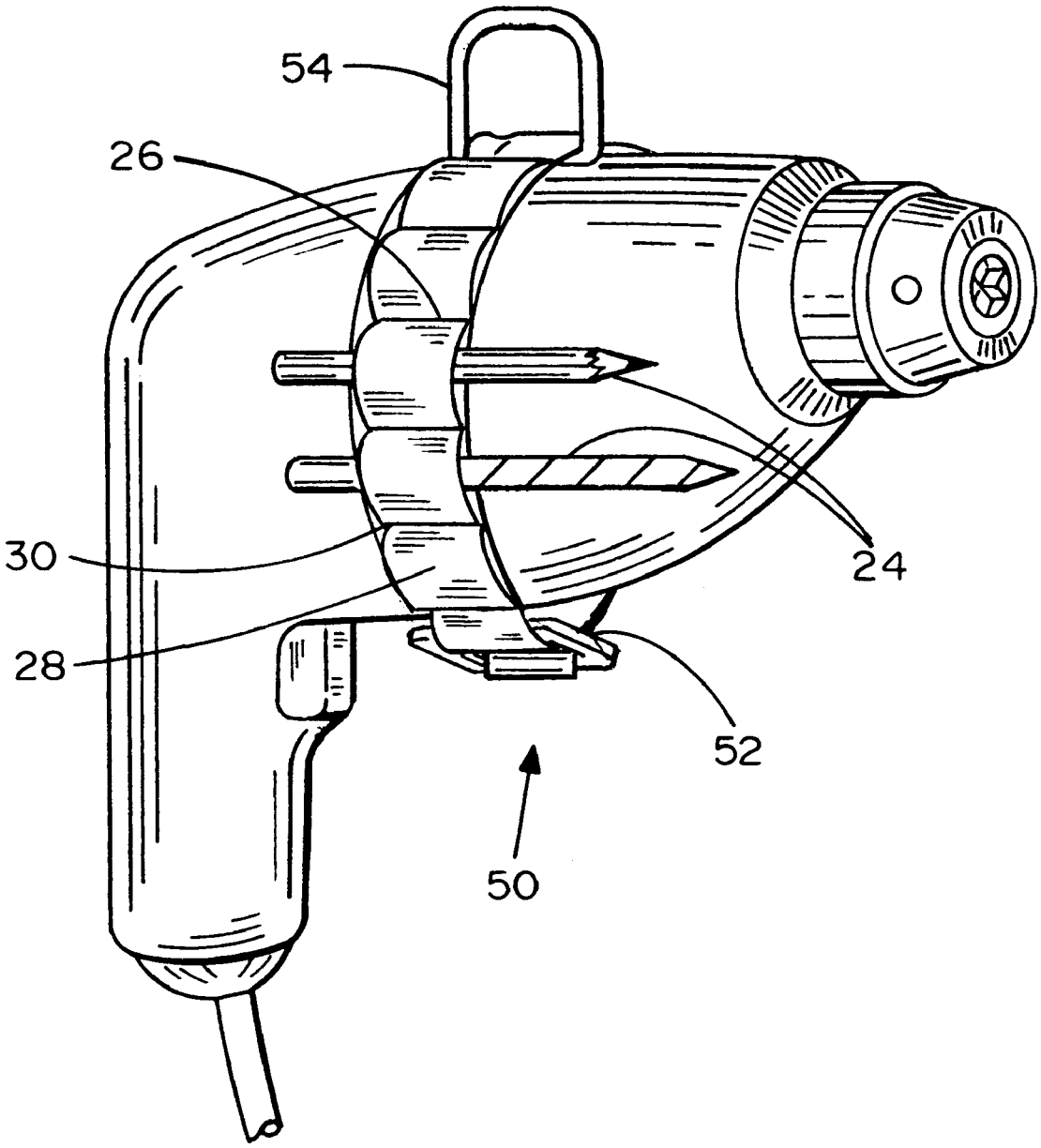
FIG. 4 a perspective view of a holding belt system embodiment of the present invention attached to a drill.

Referring to FIG. 4, another embodiment of the present invention comprises a holding belt system 50 similar to holding strip system 20 of FIGS. 1 and 2. Holding belt system 50 provides base strip 30 and/or retaining strip 28 of extended length to form a belt. System 50 additionally comprises a closure device 52, such as a double ring, at one end of the belt, where the opposing end of the belt is fed through the double ring to securely attach system 50 to an object such as a drill. System 50 may be wrapped around any object, as one skilled in the art may realize. Additionally, system 50 provides a hanging device 54, such as a D-ring, attached to base strip 30 and/or retaining strip 28 that allows the system and any wrapped object to be hung from a nail, hook or the like for storage purposes.

Figure 5:
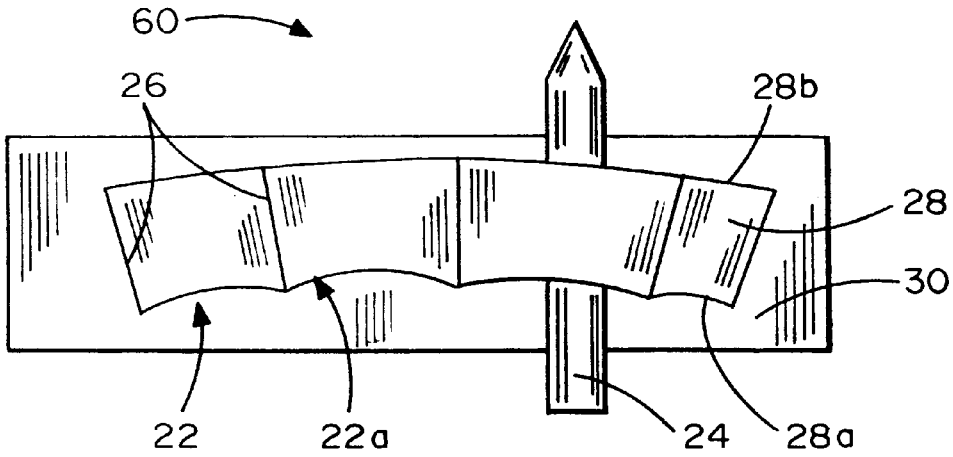
FIG. 5 is a top plan view of another embodiment of the present invention.
Figure 6:
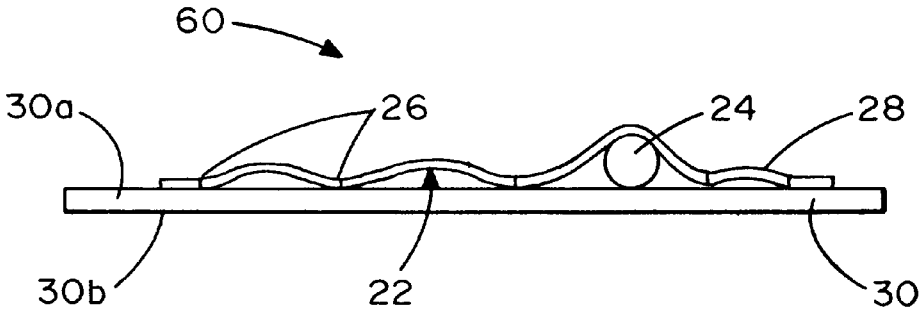
FIG. 6 is a side view of FIG. 5.

In yet another embodiment, referring to FIGS. 5 and 6, a holding strip system 60 comprises a retaining strip 28 spacedly attached to a base strip 30 forming a self-closing sleeve 22. System 60 is somewhat similar to holding strip system 20 (FIGS. 1 and 2), however, retaining strip 28 has a curved front edge 28*a* and back edge 28*b* as opposed to the substantially straight edges 28*a*, 28*b* of system 20. Additionally, system 60 does not comprise impeding member 34. Sleeve 22 of system 60 has a open-biased end 22*a* that corresponds to front edge 28*a* formed from a relaxed length of retaining strip 28. Conversely, the curvature of back edge 28*b* achieves a stretched length retaining strip 28. Therefore, system 60 provides stretched and relaxed edges 28*a*, 28*b* that are completely opposite that of system 20. Thus, this embodiment advantageously achieves the features of self-closing sleeve 22 and open-biased end 22*a* by curving retaining strip 28 with a reduced number of components.

Figure 7:
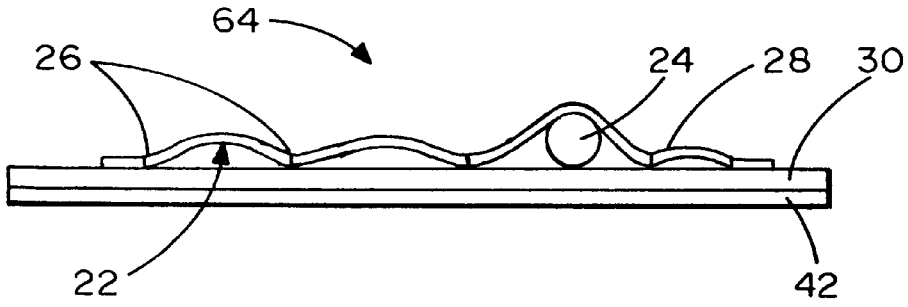
FIG. 7 is a side view, similar to that of FIG. 6, of another embodiment of the present invention.
Figure 8:
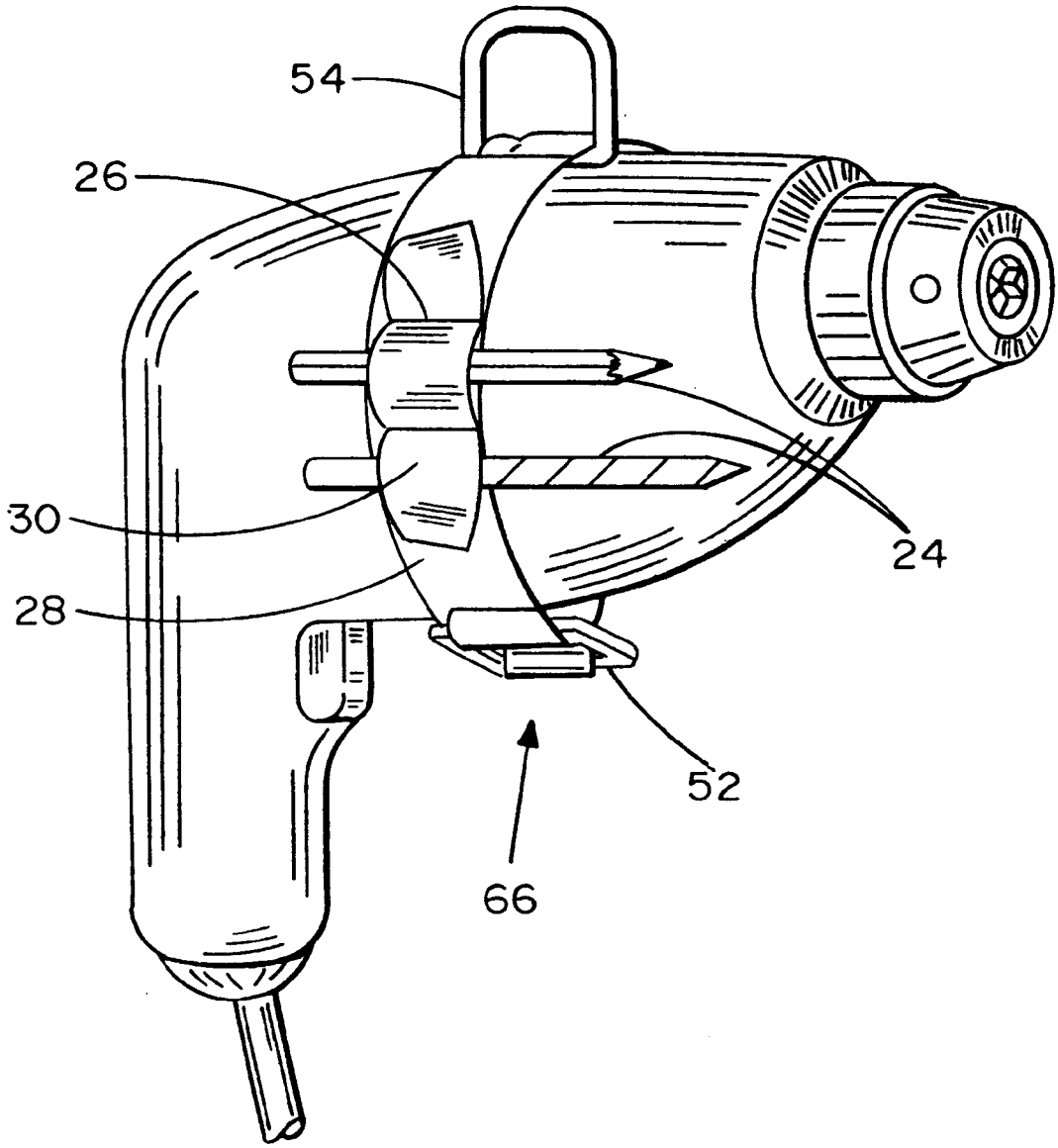
FIG. 8 a perspective view of another holding belt system embodiment of the present invention attached to a drill.

Referring to FIGS. 7 and 8, other embodiments similar to system 60 include holding strip system 64 comprising a rigid base plate 42 (FIG. 7) and holding belt system 66 comprising extended length strips 28, 30, closure device 52, such as a double ring, and a hanging device 54 such as a D-ring (FIG. 8).

Figure 9:
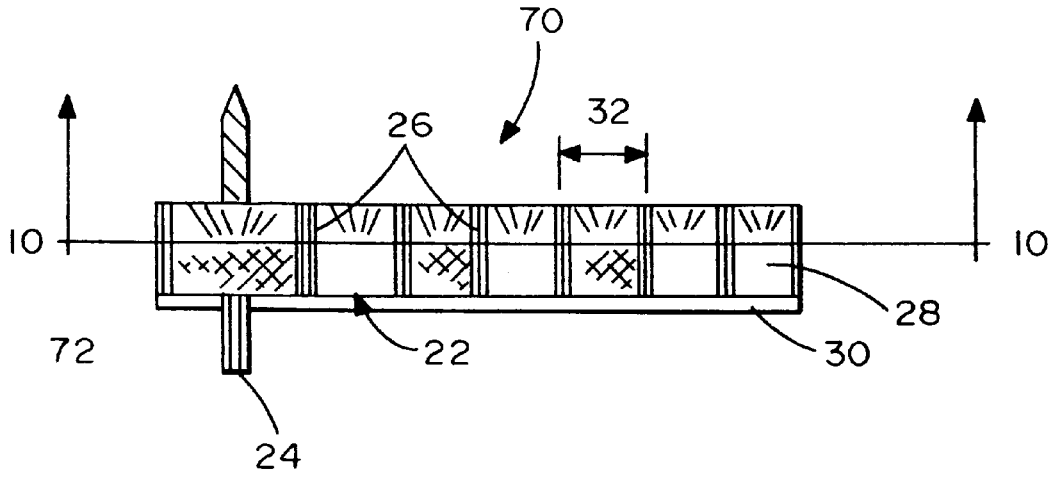
FIG. 9 is a top plan view of another embodiment of the present invention.
Figure 10:
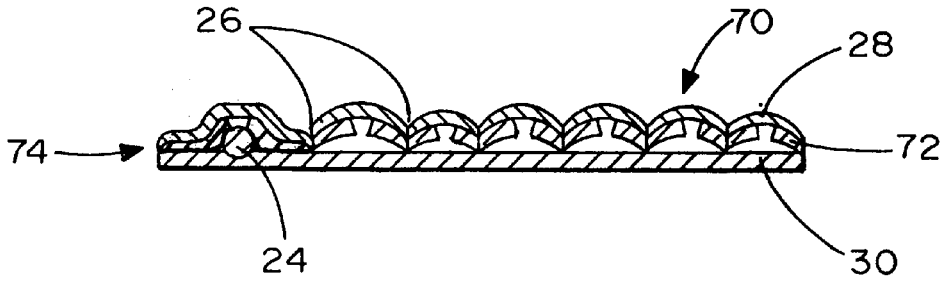
FIG. 10 is a cross-sectional side view taken along line 10—10 in FIG. 9.

According to another embodiment of the present invention, referring to FIGS. 9–10, a holding strip system 70 comprises retaining strip 28 and intermediate strip 72 affixed to base strip 30 at spaced, lateral attachments 26. As mentioned above, lateral attachment 26 comprises direct sewing, adhesive gluing, hook-and-loop fastening, sonic welding or any other secure attachment method. Preferably, retaining strip 28 is elastic, intermediate strip 72 is a non-elastic material such as a first hook-and-loop ply, and base strip 30 is a non-elastic material such as a second hook-and-loop ply.

First hook-and-loop ply 72 and second hook-and-loop ply 30, taken as a whole, comprise first hook-and-loop fastener 74. First hook-and-loop ply 72 is preferably complementary to second hook-and-loop ply 30; e.g., if a hook ply is used for the first ply, then a loop ply is used for the second ply. The present invention contemplates, however, the use of two hook plies and/or two loop plies, especially in situations where less secure holding strength is desired.

Elastic retaining strip 28 forms the upper-most exposed layer of holding system 70. The length of elastic retaining strip 28 approximates the length of holding strip system 70, although it's length may vary depending upon the application. First hook-and-loop ply 72 is affixed to elastic retaining strip 28 along lateral attachment 26 utilizing the methods described above. Lateral attachments 26 partition holding strip system 70 into a plurality of sleeves 22 that securely hold elongated articles 24. Elastic retaining strip 28 and first hook-and-loop ply 72 are gathered or bunched, then are affixed to second hook-and-loop ply 30 at lateral attachments 26 (as described above). First hook-and-loop ply 72 and second hook-and-loop ply 30 are preferably about the same length as elastic retaining strip 28, although their length may vary depending on the application. The method of gathering or bunching elastic retaining strip 28 and first hook-and-loop ply 72 are described in more detail below.

The distance between lateral attachment 26, and thus width 32 of sleeves 22, is varied to allow storage of elongated articles 24 having different thicknesses in a given sleeve 22. First hook-and-loop ply 72 and second hook-and-loop ply 30 not only increase the holding strength of elastic retaining strip 28, but also protect elastic retaining strip 28 from being damaged by elongated articles 24, which may have sharp edges or points, as they are pushed and pulled through sleeves 22.

Because first hook-and-loop ply 72 is sandwiched between second hook-and-loop ply 30 and elastic retaining strip 28, first hook-and-loop ply 72 is urged into engagement with second hook-and-loop ply 30 to securely hold elongated article 24. Thus, elongated article 24 is held not only by elastic retaining strip 28, but also by hook-and-loop plies 72 and 30. When elongated article 24 is withdrawn from sleeve 22, elastic retaining strip 28 relaxes and urges first hook-and-loop ply 72 and second hook-and-loop ply 30 into even closer engagement, thus allowing sleeves 22 to "self-close."

Beyond the self-closing embodiments previously discussed, using the preferred hook-and-loop plies, or at least a hook ply as base strip 30, an additional self-closing characteristic is obtained. In the preferred embodiment, the hook-and-loop plies are generally forced to interlock by the action of retaining strip 28. Even upon the insertion of article 24, the interface of the hook-and-loop plies not directly in contact with the elongated article remains intact. The synergistic combination of retaining strip 28 and the hook-and-loop plies thereby prevents bridging of sleeve 22 around elongated article 24. Sleeve 22 remains in a self-closed position that increases the surface area contact of the sleeve with article 24 to enhance the holding ability of the sleeve. Additional articles 24 may even be inserted in the same sleeve 22 without compromising the holding ability of the sleeve. As mentioned above, this effect may be obtained in the embodiment of a holding system comprising only a retaining strip that is a loose-weave material capable of being hooked by a base strip that is a hook ply.

Figure 11A:
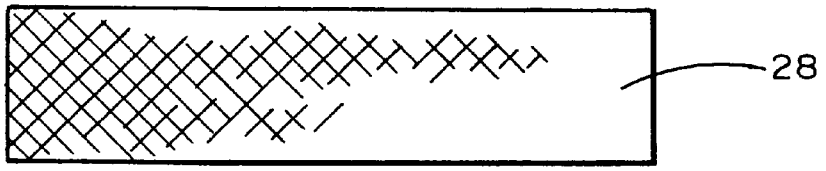
FIGS. 11A–11G is a top plan view that illustrates the method of forming the apparatus of the present invention.
Figure 11B:
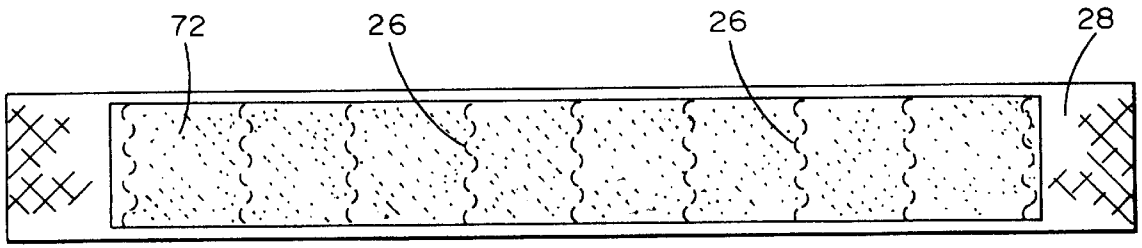

FIGS. 11A–11F illustrate the preferred method of forming holding strip system 70. FIG. 11A illustrates a section of elastic retaining strip 28. In FIG. 11B, a section of first hook-and-loop ply 72 is centered upon elastic retaining strip 28 with the hook-and-loop side of first hook-and-loop ply 72 exposed. First hook-and-loop ply 72 is then affixed to elastic retaining strip 28 at a plurality of lateral attachments 26, which are perpendicular to the length of elastic retaining strip 28. Lateral attachments 26 partition holding strip system 70 into a plurality of sleeves 22 (shown in FIGS. 9 and 10). One skilled in the art will realize, however, that the holding systems of the present invention may comprise a single sleeve 22.

Figure 11C:
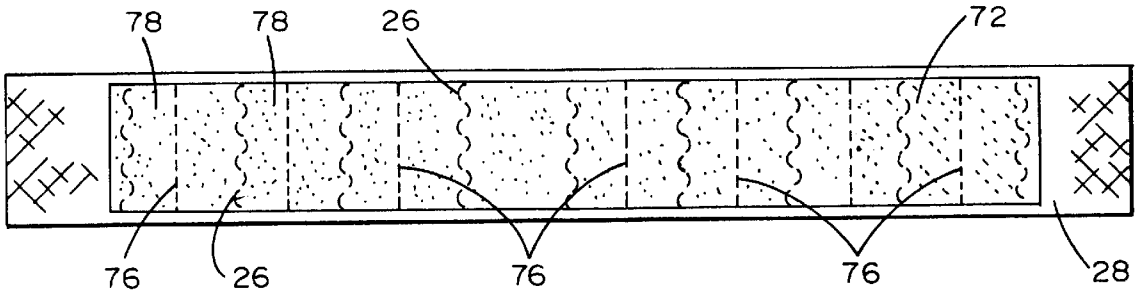

Next, in FIG. 11C, first hook-and-loop ply 72 is cut along a plurality of cut lines 76, preferably at the center of each sleeve 22. One skilled in the art will recognize, however, that cut lines 76 may be at any point within sleeve 22 and may comprise a plurality of cut lines per sleeve, which may be helpful in accommodating bulky articles 24. Cut lines 76 sever first hook-and-loop ply 72 into a plurality of shorter segments 78.

Figure 11D:
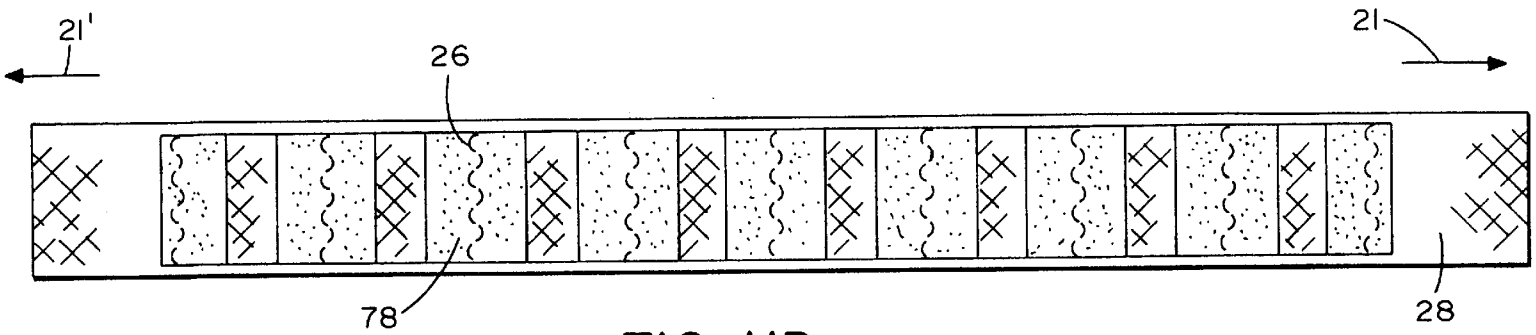

Next, in FIG. 11D, elastic retaining strip 28 is stretched lengthwise in the directions shown by arrows 21 and 21', thereby elongating elastic retaining strip 28 and separating segments 78. Lateral attachments 26 affix the centers of segments 78 relative to elastic retaining strip 28.

Figure 11E:
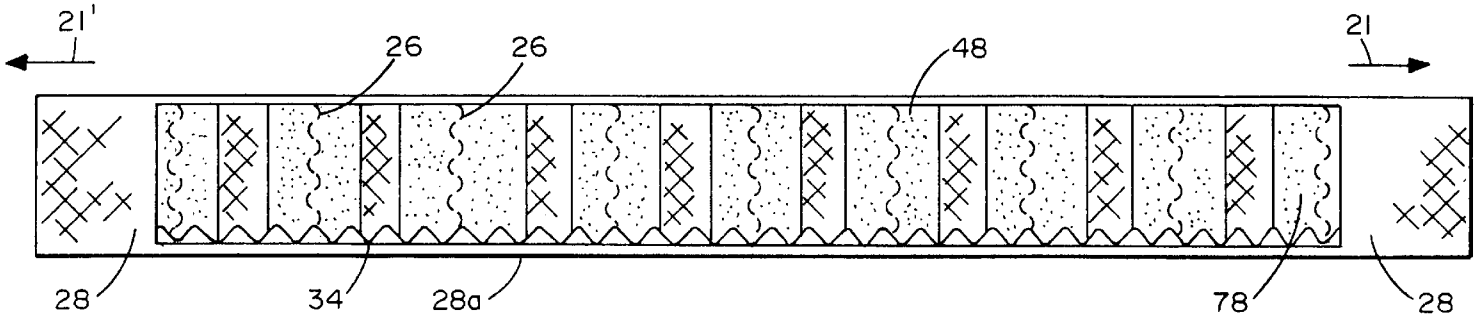

In FIG. 11E, elastic retaining strip 28 is held elongated while impeding member 34 is affixed along front edge 28*a* of retaining strip 28. As discussed above, impeding member 34 may comprise a variety of embodiments but is preferably a longitudinal stitch sewn into front edge 28*a*. Impeding member 34 affixes elastic retaining strip 28 to the plurality of segments 78 along front edge 28*a* of elastic retaining strip 28. The opposing longitudinal edge of the layered strip comprising retaining strip 28 and segments 78 is left free.

Figure 11F:
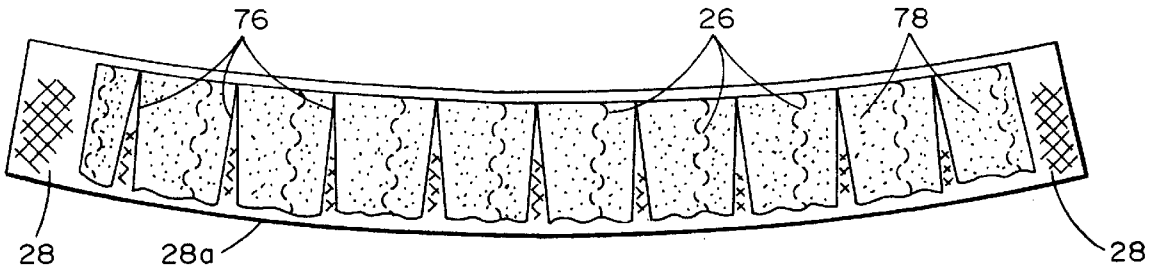
Figure 11G:
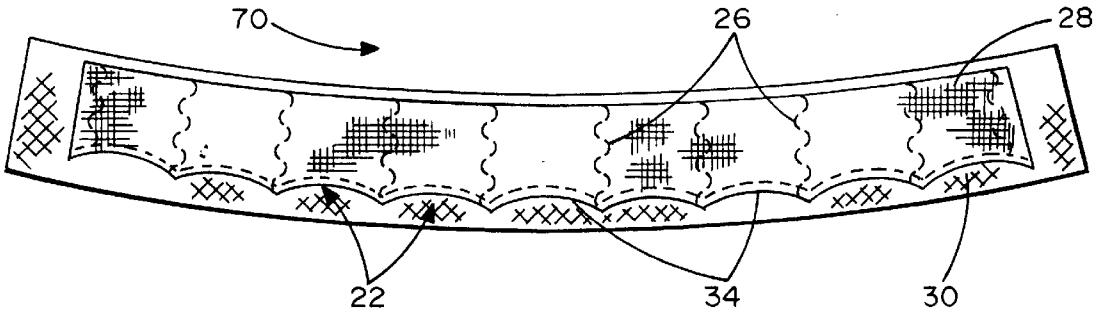

Finally, in FIGS. 11F–11G, elastic retaining strip 28 is released and allowed to contract to its original, relaxed and unstretched length. The free longitudinal edge of the layered strip comprising retaining strip 28 and segments 78 relaxes to nearly its original length; however, the longitudinal edge corresponding to front edge 28*a* cannot relax appreciably because front edge 28*a* was affixed to segments 78 by impeding member 34 while elongated. Impeding member 34 thereby prevents elastic retaining strip 28, and hence the layered strip comprising retaining strip 28 and segments 78, from fully contracting. Elastic retaining strip 28 and the plurality of segments 78 comprising first hook-and-loop ply 72 "bunch" or "gather" along the longitudinal edge affixed by impeding member 34. Holding strip system 70 is then completed by affixing elastic retaining strip 28 and first hook-and-loop ply 72 to second hook-and-loop ply 30 along lateral attachments 26, thus forming sleeves 22 (FIG. 11G).

Figure 12:
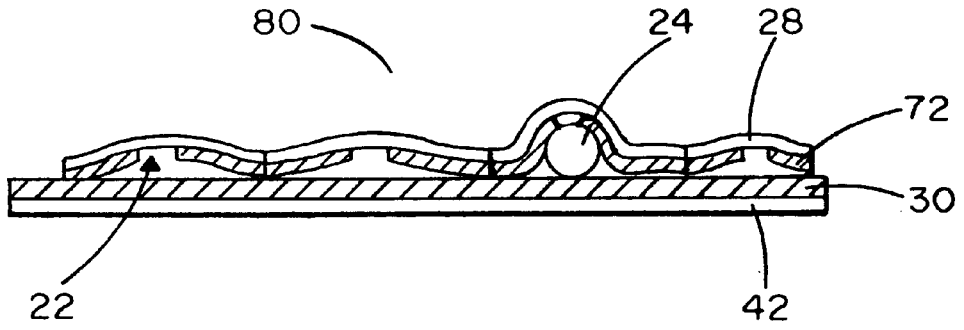
FIG. 12 is a side view, similar to that of FIG. 10, of another embodiment of the present invention.
Figure 13:
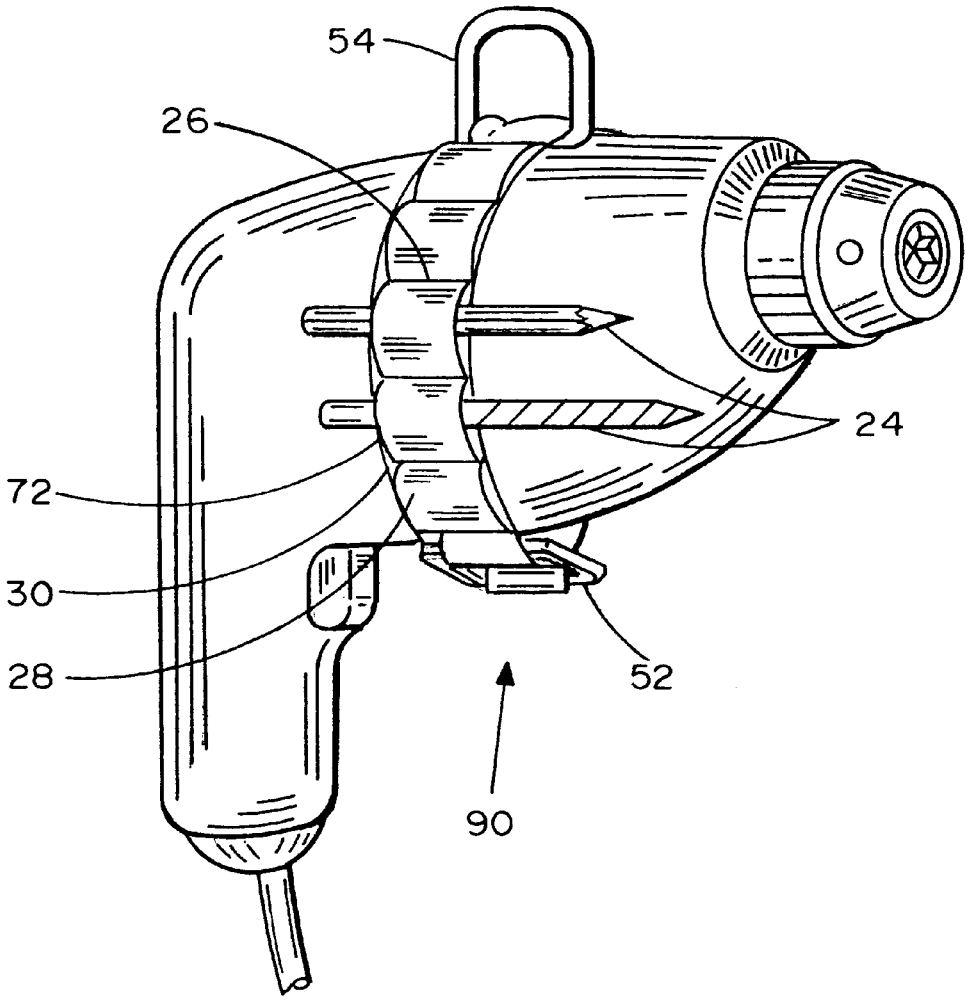
FIG. 13 a perspective view of another holding belt system embodiment of the present invention attached to a drill.

Referring to FIGS. 12 and 13, other embodiments similar to system 70 include holding strip system 80 comprising a rigid base plate 42 (FIG. 12) and holding belt system 90 comprising extended length strips 28, 30, closure device 52, such as a double ring, and a hanging device 54 such as a D-ring (FIG. 13).

EXAMPLE 1

This example describes the method of making a holding strip according to one embodiment of the present invention. This example is exemplary of a typical holding system, and is not intended to be limiting.

Following are step by step instructions for building a holding belt system with a sewing machine.

1. Cut an 8¼" piece of elastic. Sew a loop at each end by folding ½" back towards center of length and sewing with a stitch that runs from one edge to the other perpendicular to the length of material. (this is to be done on both ends.)

2. Next, cut a 6" length of loop material. Center the loop material over the elastic with the loop side exposed. Sew these lengths of elastic and loop together with stitches that are perpendicular to the lengths of fabric. These stitches are spaced at intervals identical to and indicative of the individual pockets that will be formed in step 7. This embodiment of a holding system has stitches at the following intervals starting from the left side of the loop material: 1.25", 2.5", 3.5" and 4.25". This should leave about a 1" length of free loop material on the right.

3. Cut the loop material at the center of each interval. By cutting the loop material, the loop can separate thus allowing the elastic to stretch.

4. Stretch the length of elastic and loop material over a stretching tool, such as bent aluminum.

5. Sew one edge (parallel to the length) of the stretched elastic and loop material together from the first perpendicular stitch. While the elastic is stretched, the edge should receive about three rows of stitches. The first row of stitching should be as close to the edge of elastic as possible. The other two rows should closely parallel the first row. Avoid superimposing the stitches to prevent cutting the materials. Remove the material from the stretching tool. The effect of this step is to create open-biased ends when the elastic/loop pad is allowed to relax.

6. Looped ends may be cut off the elastic at this point. Because of propensity to unravel, elastic is preferably hot-knifed or otherwise sealed.

7. Place the relaxed elastic/loop pad of material on 18" of hook material. The loop material and the hook material should interlock as is the nature of hook & loop material. Position the elastic/loop pad on the hook material. When the pad is positioned on the hook material:

- the materials should sit straight and parallel to the length of hook material.
- the pad edge opposite flared openings (open-biased ends) should be parallel and flush with one edge of the hook material.
- non-flared edges of cut loop should not overlap. Edges should meet. (original position of loop edges before being cut.)
  - pad should be positioned as close as possible to fastening buckles.
  - pad and D-ring should be positioned straight on the belt.

Now, sew the pad to the base material (hook) via stitches that run perpendicular to the length. The stitches should be located exactly where the stitches in step 2 were located. Preferably, sew each location twice and move to hook material and then sew to next seam location and sew twice and then move to next seam and repeat until all seams defining pockets have been sewn twice. The result is one continuous seam. This step saves time, thread and results in a stronger product.

8. As stated in Step 4, there should be a 1" length of elastic and loop material that are unsecured on the side of the pad opposite the buckles. This is used to hold a D-ring. Place the D-ring under elastic and loop. Fold heat-sealed end of elastic under and sew hook material via 2 side by side seams running parallel to the stitches in step 6 (i.e. perpendicular to the length of strap).

Although the invention has been described with reference to these preferred embodiments, other embodiments can achieve the same results. Variations and modifications of the present invention will be apparent to one skilled in the art and the following claims are intended to cover all such modifications and equivalents.

What is claimed is:

1. A holder for an elongate article, comprising:

a first substantially non-elastic strip; and a second substantially elastic strip, having a first edge of a stretched length and a second edge of a relaxed length, spacedly attached to said first strip.

2. A holder for elongate articles as recited in claim 1, further comprising a self-closing sleeve formed between said spaced attachment of said first strip and said second strip.

3. A holder for elongate articles as recited in claim 2, wherein said sleeve further comprises a open-biased end.

4. A holder for elongate articles as recited in claim 3, wherein said open-biased end corresponds to said first edge of said second strip.

5. A holder for elongate articles as recited in claim 4, wherein said second strip comprises substantially straight longitudinal edges.

6. A holder for elongate articles as recited in claim 2, wherein said sleeve further comprises a open-biased end corresponding to said second edge of said second strip.

7. A holder for elongate articles as recited in claim 6, wherein said second strip comprises substantially curved longitudinal edges.

8. A holder for elongate articles as recited in claim 3, wherein said first strip has a width wider than a width of said second strip.

9. A holder for elongate articles as recited in claim 1, wherein said first edge of said second strip is sewn to achieve said stretched length.

10. A holder for elongate articles as recited in claim 1, wherein said first strip comprises a hook ply.

11. A holder for elongate articles as recited in claim 1, further comprising a rigid base attached to said first strip.

12. A holder for elongate articles as recited in claim 1, further comprising a hanger device movably attached to at least one of said first strip or said second strip.

13. A holder for elongate articles as recited in claim 1, further comprising a closure device movably attached to at least one of said first strip or said second strip.

14. A holder for elongate articles, comprising:

a first substantially non-elastic strip;

a second substantially non-elastic strip adjacent said first strip;

a third substantially elastic strip, having a first edge of a stretched length and a second edge of a relaxed length, spacedly attached to said first strip and said second strip.

15. A holder for elongate articles as recited in claim 14, further comprising a self-closing sleeve formed between said spaced attachment of said first strip, said second strip and said third strip.

16. A holder for elongate articles as recited in claim 15, wherein said sleeve further comprises a open-biased end.

17. A holder for elongate articles as recited in claim 16, wherein said open-biased end corresponds to said first edge of said third strip.

18. A holder for elongate articles as recited in claim 17, wherein said third strip comprise substantially straight longitudinal edges.

19. A holder for elongate articles as recited in claim 16, wherein said sleeve further comprises a open-biased end corresponding to said second edge of said third strip.

20. A holder for elongate articles as recited in claim 19, wherein said third strip comprise substantially curved longitudinal edges.

21. A holder for elongate articles as recited in claim 14, wherein said first strip has a width wider than a width of said second strip and a width of said third strip.

22. A holder for elongate articles as recited in claim 14, wherein said first edge of said third strip is sewn to achieve said stretched length.

23. A holder for elongate articles as recited in claim 14, wherein said first strip comprises a hook-and-loop ply.

24. A holder for elongate articles as recited in claim 23, wherein said second strip comprises a hook-and-loop ply complementary to said hook-and-loop ply of said first strip.

25. A holder for elongate articles as recited in claim 14, further comprising a rigid base attached to said first strip.

26. A holder for elongate articles as recited in claim 14, further comprising a hanger device movably attached to at least one of said first strip, said second strip or said third strip.

27. A holder for elongate articles as recited in claim 14, further comprising a closure device movably attached to at least one of said first strip, said second strip or said third strip.

28. A holder for elongate articles, comprising a first hook-and-loop ply;

a substantially elastic strip having a first edge of a stretched length and a second edge of a relaxed length; and a second hook-and-loop ply, complementary to said first hook-and-loop ply, between said first hook-and-loop ply and said elastic strip, wherein said first ply, said elastic strip and said second ply are spacedly attached.

29. A holder for elongate articles as recited in claim 28, further comprising a rigid base attached to said first hook-and-loop ply.

30. A method of making a holder for elongate articles, comprising:

(a) expanding a substantially elastic strip in the longitudinal direction to a stretched length;

(b) constraining one longitudinal edge of the elastic strip from releasing to a relaxed length; and (c) spacedly affixing the elastic strip to a substantially non-elastic strip.

31. A method of making a holder for elongate articles as recited in claim 30, further comprising affixing a rigid base to the non-elastic strip.

32. A method of making a holder for elongate articles as recited in claim 30, wherein the non-elastic strip is a first hook-and-loop ply.

33. A method of making a holder for elongate articles as recited in claim 32, further comprising spacedly affixing a second hook-and-loop ply, complementary to the first hook-and-loop ply, between the elastic strip and the first hook-and-loop ply.

34. A method of making a holder for elongate articles as recited in claim 33, further comprising affixing a rigid base to the non-elastic strip.

35. A method of forming a pad for holding items, comprising:

(a) attaching an elastic member to a first hook-and-loop ply of a hook-and-loop fastener, the hook-and-loop fastener further having a second hook-and-loop ply;

(b) gathering the first hook-and-loop ply and the elastic member relative to the second hook-and-loop ply to form at least one sleeve for holding the items; and (c) joining the elastic member and the first hook-and-loop ply to the second hook-and-loop ply so that the elastic member urges the first hook-and-loop ply into complementary engagement with the second hook-and-loop ply to form the pad.

36. The method of claim 35, wherein attaching the elastic member to the first hook-and-loop ply comprises sewing the elastic member to the first hook-and-loop ply along a plurality of lines perpendicular to the length of the elastic member.

37. The method of claim 35, wherein gathering the first hook-and-loop ply and the elastic member comprises cutting the first hook-and-loop ply into a plurality of segments.

38. The method of claim 37, wherein gathering the first hook-and-loop ply and the elastic member comprises stretching the elastic member after cutting the first hook-and-loop ply.

39. The method of claim 38, wherein gathering the first hook-and-loop ply and the elastic member comprises sewing the elastic member to the first hook-and-loop ply along one longitudinal edge of the elastic member while the elastic member remains stretched.

40. A method of holding an elongate item, comprising:

(a) attaching an elastic member to a first hook-and-loop ply of a hook-and-loop fastener, the hook-and-loop fastener further having a second hook-and-loop ply;

(b) gathering the first hook-and-loop ply and the elastic member relative to the second hook-and-loop ply to form at least one sleeve for holding the elongate item;

(c) joining the elastic member and the first hook-and-loop ply to the second hook-and-loop ply so that the elastic member urges the first hook-and-loop ply into complementary engagement with the second hook-and-loop ply; and (d) inserting the elongate item into the at least one sleeve.

41. The method of claim 40, wherein attaching an elastic member to the first hook-and-loop ply comprises laterally sewing the elastic member to the first hook-and-loop ply along a plurality of lines.

42. The method of claim 40, further comprising securing the first hook-and-loop fastener about an object with a second hook-and-loop fastener.

43. The method of claim 42, wherein securing the first hook-and-loop fastener about an object comprises securing the first hook-and-loop fastener to the object with a double loop.

44. A method for forming an elastic belt having a plurality of sleeves, the method comprising:

(a) stretching an elongated elastic member;

(b) placing a stitch along one longitudinal edge of the elastic member;

(c) releasing the elastic member, thereby allowing the stitched longitudinal edge of the elastic member to gather relative to the unstitched longitudinal edge; and (d) attaching the elastic member to a strap at spaced, lateral attachments that define the plurality of sleeves.

45. The method of claim 44, wherein placing a stitch along one longitudinal edge comprises placing a stitch along one longitudinal edge of the elastic member while the elastic member remains stretched.

46. The method of claim 44, wherein stretching the elongated elastic member comprises stretching an elastic strap.

* * * * *